US005773408A

United States Patent [19]

Trinh et al.

[11] Patent Number: 5,773,408

[45] Date of Patent: Jun. 30, 1998

[54] DRYER-ACTIVATED FABRIC CONDITIONING COMPOSITIONS CONTAINING UNCOMPLEXED CYCLODEXTRIN

[75] Inventors: Toan Trinh, Maineville; Helen Bernardo Tordil, West Chester, both of Ohio

[73] Assignee: The Procter & Gamble Company, Cincinnati, Ohio

[21] Appl. No.: 840,527

[22] Filed: Apr. 22, 1997

Related U.S. Application Data

[62] Division of Ser. No. 590,711, Jan. 24, 1996, Pat. No. 5,681,806, which is a continuation of Ser. No. 278,703, Jul. 21, 1994, abandoned, which is a continuation of Ser. No. 40,703, Mar. 31, 1993, abandoned.

[51] Int. Cl.[6] ..... C11D 3/382

[52] U.S. Cl. ..... 510/520; 510/519

[58] Field of Search ..... 510/519, 520, 510/521, 515, 516, 518, 504, 499, 470, 505, 441, 330

[56] References Cited

U.S. PATENT DOCUMENTS

| | | | |
|---|---|---|---|
| 4,267,166 | 5/1981 | Yajima | 424/48 |
| 4,727,824 | 3/1988 | Ducharme et al. | 119/1 |
| 4,986,922 | 1/1991 | Snow et al. | 252/8.8 |
| 5,094,761 | 3/1992 | Trinh et al. | 252/8.9 |
| 5,102,564 | 4/1992 | Gardlik et al. | 252/8.9 |
| 5,139,687 | 8/1992 | Borcher, Sr. et al. | 252/8.6 |
| 5,234,610 | 8/1993 | Gardlik et al. | 252/8.6 |
| 5,236,615 | 8/1993 | Trinh et al. | 252/174.11 |
| 5,348,667 | 9/1994 | Bacon et al. | 252/8.6 |

FOREIGN PATENT DOCUMENTS

| | | | |
|---|---|---|---|
| 124452 | 7/1983 | Japan | A61L 9/91 |
| 128973 | 6/1986 | Japan | A61F 9/01 |
| 63-164953 | 7/1988 | Japan . | |
| 63-165498 | 7/1988 | Japan | C11D 10/02 |
| 3-170415 | 7/1991 | Japan | A61K 7/32 |

OTHER PUBLICATIONS

H. Hashimoto, "Application of Cyclodextrins to Foods, Toiletries and Other Products in Japan," (1988) pp. 1–12.

H. Hashimoto, "Studies on the Industrial Production and Application of Cyclodextrins," Denpun Kagaku, vol. 36, No. 1, pp. 35–42, (1–15) (1989).

*Primary Examiner*—Paul Lieberman
*Assistant Examiner*—John R. Hardee
*Attorney, Agent, or Firm*—Robert B. Aylor

[57] ABSTRACT

An effective amount of uncomplexed cyclodextrin, in the form of particles having particle sizes below about 12 microns, is incorporated into solid dryer-activated fabric conditioning compositions which are used in dryers to treat fabrics. The cyclodextrin is thereby attached to the fabrics and subsequently provides effective control of odors when they come in contact with the treated fabric. The fabric conditioning compositions can be attached to substrates to prepare an article of manufacture or be in the form of detergent compatible particles, for use with conventional laundry detergents.

10 Claims, No Drawings

DRYER-ACTIVATED FABRIC CONDITIONING COMPOSITIONS CONTAINING UNCOMPLEXED CYCLODEXTRIN

This is a division of application Ser. No. 08,590,711, filed on Jan. 24. 1996 now U.S. Pat. No. 5,681,806; which is a continuation of Ser. No. 08/278.703, filed on Jul. 21, 1994, now abandoned; which is a continuation of Ser. No. 08/040,703, filed Mar. 31, 1993. now abandoned.

TECHNICAL FIELD

The present invention relates to an improvement in dryer activated, e.g., dryer-added, fabric conditioning (softening) products and/or compositions, said products, and/or compositions, being, preferably, either in particulate form; compounded with other materials in solid form, e.g., tablets, pellets, agglomerates, etc.; or attached to a substrate.

BACKGROUND OF THE INVENTION

The use of cyclodextrin as a complexing agent for materials is well documented, including the disclosures in U.S. Pat. Nos.: 4,348,416, Boden (flavoring material for use in chewing gum, dentifrices, cosmetics, etc.); 4,296,138, Boden (similar to 4,348,416); 4,265,779, Gandolfo et al. (suds suppressors for use in detergent compositions); 4,547,365, Kubo et al. (cyclodextrin/-hair-waving-active complexes); 4,548,811, Kubo et al. (waving lotion); 4,616,008, Hirai et al. (antibacterial complexes); and 4,732,759 and 4,728,510, Shibanai et al. (complexes of bath additives), all of said patents being incorporated by reference. Despite the voluminous art relating to the preparation and use of cyclodextrin complexes in various products, there has been much less activity relative to the use of free, uncomplexed cyclodextrin as a material to absorb, e.g., odors, out of the air. There has been a disclosure of using free, uncomplexed cyclodextrin in an aqueous fabric softener composition (Laid Open Jap. Pat. Appln. 63-165,498, Jul. 8, 1988), but nothing relative to the use of uncomplexed cyclodextrin in dryer-added fabric conditioning/softener compositions.

Cyclodextrin actives have been disclosed as set forth in detail in the patents incorporated by reference herein. However, for commercial success, the effect must be obtained consistently and the cost must be commensurate with the benefit obtained. Use of a large particle size or an aqueous softener composition delivery system results in insufficient control of odors by cyclodextrin. There has been no discussion in the art of small particle size uncomplexed cyclodextrin delivered by a dryer-activated product to fabric.

SUMMARY OF THE INVENTION

It has now been discovered that free cyclodextrin incorporated into solid dryer activated fabric conditioning compositions, especially those comprising a fabric softening agent, can control odor and that small particle size cyclodextrin can control odors more effectively, especially those containing at least an effective amount of cyclodextrin having a particle size of less than about 12, preferably less than about 10, more preferably less than about 8, and even more preferably less than about 5, typically between about 0.001 and about 10, preferably between about 0.05 and about 5 microns (micrometers). The small particle cyclodextrins provide a remarkable and totally unexpected improvement in the control of malodors, e.g., cigarette odor, when applied from a dryer-activated fabric softener composition. This odor control was not expected in view of the prior art. Fabrics which are treated with the small particle size free cyclodextrin are noticeably less smelly when they are exposed to air containing malodors.

The advantage of improved odor control is especially important when the odor is being released from the underarm area and there is limited time to diminish the odor before it escapes to the air. When the amount of time available to effect odor control is limited, small particles are essential to provide the speed of odor absorption required to give a noticeable effect.

DESCRIPTION OF THE INVENTION

Cyclodextrin can be obtained in small particle form by grinding larger particles, e.g., those made by normal crystallization processes to achieve the desired particle size. One can also modify the crystallization process to affect the size of the precipitated particles. For any use that requires fast odor control, the particle size reduction is essential to see the full benefit of the cyclodextrin. At least an effective amount of the cyclodextrin should be in small particle form. Effective amounts depend upon the delivery effectiveness and the end result desired.

1. CYCLODEXTRINS

As used herein, the term "cyclodextrin" (CD) includes any of the known cyclodextrins such as unsubstituted cyclodextrins containing from six to twelve glucose units, especially, alpha-, beta-, gamma-cyclodextrins, and mixtures thereof, and/or their derivatives, and/or mixtures thereof, that are capable of forming inclusion complexes with odor materials. Beta-cyclodextrin is the most preferred cyclodextrin and the one which benefits most from the small particle size. Alpha-, beta-, and gamma-cyclodextrins can be obtained from, among others, American Maize-Products Company (Amaizo), Hammond, Indiana; and Roquette Corporation, Gurnee, Ill. There are many derivatives of cyclodextrins that are known. Representative derivatives are those disclosed in U.S. Pat. Nos: 3,426,011, Parmerter et al., issued Feb. 4, 1969; 3,453,257, 3,453,258, 3,453,259, and 3,453,260, all in the names of Parmerter et al., and all issued Jul. 1, 1969; 3,459,731, Gramera et al., issued Aug. 5, 1969; 3,553,191, Parmerter et al., issued Jan. 5, 1971; 3,565,887, Parmerter et al., issued Feb. 23, 1971; 4,535,152, Szejtli et al., issued Aug. 13, 1985; 4,616,008, Hirai et al., issued Oct. 7, 1986; 4,638,058, Brandt et al., issued Jan. 20, 1987; 4,746,734, Tsuchiyama et al., issued May 24, 1988; and 4,678,598, Ogino et al., issued Jul. 7, 1987, all of said patents being incorporated herein by reference. Examples of cyclodextrin derivatives suitable for use herein are methyl-β-CD, hydroxyethyl-β-CD, and hydroxypropyl-β-CD of different degrees of substitution (DS), available from, among others, Amaizo; Aldrich Chemical Company, Milwaukee, Wisconsin; and Wacker Chemicals (USA), New Canaan, Connecticut. Water-soluble derivatives are also highly desirable.

The individual cyclodextrins can also be linked together, e.g., using multifunctional agents to form oligomers, polymers, etc. Examples of such materials are available commercially from Amaizo and from Aldrich Chemical Company (β-CD/epichlorohydrin copolymers).

It is also desirable to use mixtures of cyclodextrins to provide odor control for a variety of odor materials. Such mixtures, e.g., can provide broader odor control by complexing with a wider range of odorous materials. Mixtures of cyclodextrins can conveniently be obtained by using intermediate products from known processes for the preparation of cyclodextrins including those processes described in U.S. Pat. Nos.: 3,425,910, Armbruster et al., issued Feb. 4, 1969; 3,812,011, Okada et al., issued May 21, 1974; 4,317,881, Yagi et al., issued Mar. 2, 1982; 4,418,144, Okada et al., issued Nov. 29, 1983; and 4,738,923, Ammeraal, issued Apr. 19, 1988, all of said patents being incorporated herein by reference. Preferably at least a major portion of the cyclodextrins are alpha-cyclodextrin, beta-cyclodextrin, and/or gamma-cyclodextrin, more preferably beta-cyclodextrin. Some cyclodextrin mixtures are commercially available from, e.g., Ensuiko Sugar Refining Company, Yokohama, Japan.

2. CYCLODEXTRIN PARTICLE SIZES

As used herein, "cyclodextrin" refers to both the free cyclodextrin, and any optional complexed cyclodextrin that is present, when particle size is discussed. The particle sizes of the cyclodextrins herein are selected to improve the pick-up of odors and/or the release, and especially the rate-of-release, of any perfume from a complex.

In the normal production process, the cyclodextrins are isolated effectively and conveniently by fractional crystallization. This process normally produces crystalline solids having particle sizes of about 20 microns or larger. A beta-cyclodextrin sample obtained from the American Maize-Products Company is composed of about 88% of cyclodextrin with particle size larger than 20 microns, and with about 58% of cyclodextrin with particle size in the 49 to 118 micron range, as determined by a Malvern Particle and Droplet Sizer, Model 2600C, sold by Malvern Instruments, Inc., Southborough, Mass. Surface area availability of the uncomplexed cyclodextrin is essential for effective and efficient odor control performance by cyclodextrin powder. By way of exemplification, for particles of essentially the same shape, all particles having the same exact size, one gram of cyclodextrin of 5 micron size has the same surface area as 100 g of cyclodextrin of 50 micron size, and 1 g of cyclodextrin of 3 micron size has the same surface area as 1600 g of cyclodextrin of 120 micron size.

The small particles of this invention, e.g., those having a particle size of less than about 12 microns, preferably less than about 10 microns, more preferably less than about 8 microns, and even more preferably less than about 5 microns, are desirable for providing a quick pickup of odor, or release of perfume, when the complexes are wetted.

The particle size range is typically between about 0.001 and 10 microns, preferably between about 0.05 and 5 microns. It is highly desirable that at least an effective amount of the active be in complexes having the said particle sizes. It is desirable that at least about 75%, preferably at least about 80% and more preferably at least about 90% of the complex that is present have the said particle sizes. It is even better if essentially all of the complex has the said particle sizes.

These small particles of the invention are conveniently prepared by mechanical, e.g., grinding techniques. Cyclodextrin, and/or cyclodextrin complexes, with large particle sizes can be pulverized to obtain the desired smaller particles of about 10 microns and less by using, e.g., a fluid energy mill. Examples of fluid energy mills are the Trost Air Impact Pulverizers, sold by Garlock Inc., Plastomer Products, Newtown, Pa.; the Micronizer fluid energy mills sold by Sturtevant, Inc., Boston, Mass.; and the Spiral Jet Mill sold by Alpine Division, MicroPul Corporation (Hosokawa Micron International, Inc.), Summit, N.J. The optional small particle size cyclodextrin/perfume complex is preferably prepared by mechanical methods, e.g., kneading a slurry of the cyclodextrin and the perfume.

As used herein, the particle size refers to the largest dimension of the particle and to the ultimate (or primary) particles. The size of these primary particles can be directly determined with optical or scanning electron microscopes. The slides must be carefully prepared so that each contains a representative sample of the bulk cyclodextrin. The particles' sizes can also be measured by any of the other well-known methods, e.g., wet sieving, sedimentation, light scattering, etc. A convenient instrument that can be used to determine the particle size distribution of the dry cyclodextrin powder directly (without having to make a liquid suspension or dispersion) is the Malvern Particle and Droplet Sizer, Model 2600C, sold by Malvern Instruments, Inc., Southborough, Mass. Some caution should be observed in that some of the dry particles may remain agglomerated. The presence of agglomerates can be further determined by microscopic analysis. Some other suitable methods for particle size analysis are described in the article "Selecting a particle size analyzer: Factors to consider," by Michael Pohl, published in Powder and Bulk Engineering, Volume 4 (1990), pp. 26–29, incorporated herein by reference. It is recognized that the very small particles of the invention can readily aggregate to form loose agglomerates that are easily broken apart by either some mechanical action or by the action of water. Accordingly, particles should be measured after they are broken apart, e.g., by agitation or sonication. The method, of course, should be selected to accommodate the particle size and maintain the integrity of the complex particles, with iterative measurements being made if the original method selected proves to be inappropriate. Care should be taken to avoid contact of the cyclodextrin particles with water to prevent premature dissolution.

3. THE COMPOSITIONS

The present invention also relates to improved solid dryer-activated fabric softener compositions which are either (A) incorporated into articles of manufacture in which the compositions containing the small particle cyclodextrin are, e.g., on a substrate, or, are (B) in the form of particles (including, where appropriate, agglomerates, pellets, and tablets of said particles). Such compositions contain from about 10% to about 95% of fabric softening agent and at least an effective amount of said small particle size cyclodextrin.

A. Substrate Articles

In preferred embodiments, the present invention encompasses articles of manufacture. Representative articles are those that are adapted for use to provide unique perfume benefits and to soften fabrics in an automatic laundry dryer, of the types disclosed in U.S. Pat. Nos.: 3,989,631 Marsan, issued Nov. 2, 1976; 4,055,248, Marsan, issued Oct. 25, 1977; 4,073,996, Bedenk et al., issued Feb. 14, 1978; 4,022,938, Zaki et al., issued May 10, 1977; 4,764,289, Trinh, issued Aug. 16, 1988; 4,808,086, Evans et al., issued Feb. 28,1989; 4,103,047, Zaki et al., issued Jul. 25, 1978; 3,736,668, Dillarstone, issued Jun. 5, 1973; 3,701,202, Compa et al., issued Oct. 31,1972; 3,634,947, Furgal, issued Jan. 18, 1972; 3,633,538, Hoeflin, issued Jan. 11, 1972; and 3,435,537, Rumsey, issued Apr. 1, 1969; and 4,000,340, Murphy et al., issued Dec. 28, 1976, all of said patents being incorporated herein by reference.

Typical articles of manufacture of this type include articles comprising:

I. a fabric conditioning composition comprising:

i. from about 30% to about 95% of normally solid, dryer softenable material, typically fabric softening agent; and ii. an effective amount, preferably from about 5% to about 70%, of uncomplexed particulate cyclodextrin having a particle size of less than about 12 microns, as described hereinbefore;

iii. optionally, an effective amount, preferably from about 0.5% to about 60%, of perfume/cyclodextrin complex, as described hereinafter;

II. a dispensing means which provides for release of an effective amount of said composition including an effective amount of ii, sufficient to provide odor control, to fabrics in an automatic laundry dryer at automatic laundry dryer operating temperatures, e.g., from about 35° C. to 115° C.

When the dispensing means is a flexible substrate, e.g., in sheet configuration, the fabric conditioning composition is releasably affixed on the substrate to provide a weight ratio of conditioning composition to dry substrate ranging from about 10:1 to about 0.5:1, preferably from about 5:1 to about 1:1. The invention also comprises the method of manufacturing such an article of manufacture utilizing said uncomplexed cyclodextrin and optional complex iii., either by application of the cyclodextrin, and optional complex iii. directly to said dispensing means II., or by premixing the cyclodextrin and any complex iii. with the fabric softening agent i. The softener helps protect the complex from the water in the environment which is desirable. However, separate application of cyclodextrin, whether uncomplexed or as a complex, to said substrate is also possible and can diminish interaction of softener ingredients with any perfume. The cyclodextrin requires some material to affix it to the dispensing means, i.e., to "immobilize" it, said material being "mobilized" by the dryer to release the uncomplexed cyclodextrin from the dispensing means and then affix ("immobilize") said uncomplexed cyclodextrin on fabrics that are being dried.

The term "fabric softening agent" as used herein includes cationic and nonionic fabric softeners used alone and also in combination with each other. A preferred fabric softening agent of the present invention is a mixture of cationic and nonionic fabric softeners.

(i) Fabric Softening Agents

Examples of fabric softening agents that are especially useful in the substrate articles are the compositions described in U.S. Pat. Nos. 4,103,047, Zaki et al., issued Jul. 25, 1978; 4,237,155, Kardouche, issued Dec. 2, 1980; 3,686,025, Morton, issued Aug. 22, 1972; 3,849,435, Diery et al., issued Nov. 19, 1974; and U.S. Pat. No. 4,073,996, Bedenk, issued Feb. 14, 1978; said patents are hereby incorporated herein by reference.

Another preferred type of fabric softener is described in detail in U.S. Pat. No. 4,661,269, Toan Trinh, Errol H. Wahl, Donald M. Swartley and Ronald L. Hemingway, issued April 28, 1987, said patent being incorporated herein by reference.

Examples of nonionic fabric softeners are the sorbitan esters, $C_{12}$–$C_{26}$ fatty alcohols, and fatty amines described herein.

More biodegradable fabric softener compounds can be desirable. Biodegradability can be increased, e.g., by incorporating easily destroyed linkages into hydrophobic groups. Such linkages include ester linkages, amide linkages, and linkages containing unsaturation and/or hydroxy groups. Examples of such fabric softeners can be found in U.S. Pat. Nos.: 3,408,361, Mannheimer, issued Oct. 29, 1968; 4,709,045, Kubo et al., issued Nov. 24, 1987; 4,233,451, Pracht et al., issued Nov. 11, 1980; 4,127,489, Pracht et al., issued Nov. 28, 1979; 3,689,424, Berg et al., issued Sep. 5, 1972; 4,128,485, Baumann et al., issued Dec. 5, 1978; 4,161,604, Elster et al., issued Jul. 17, 1979; 4,189,593, Wechsler et al., issued Feb. 19, 1980; and 4,339,391, Hoffman et al., issued Jul. 13, 1982, said patents being incorporated herein by reference.

A preferred article of the present invention includes a fabric treatment composition which comprises from about 5% to about 70%, preferably from about 10% to about 60%, more preferably from about 15% to about 50%, of uncomplexed cyclodextrin ii, as discussed hereinbefore, and from about 30% to about 95%, preferably from about 40% to about 90%, of fabric conditioning (softening) agent. Preferably, said fabric softening agent is selected from cationic and nonionic fabric softeners and mixtures thereof. Preferably, said fabric softening agent comprises a mixture of about 5% to about 95% of a cationic fabric softener and about 5% to about 95% of a nonionic fabric softener by weight of said fabric treatment agent. The selection of the components is such that the resulting fabric treatment composition has a melting point above about 38° C. and is flowable at dryer operating temperatures.

(ii) Uncomplexed Cyclodextrin

The uncomplexed cyclodextrin is the one discussed herein-before in detail.

(iii) Cyclodextrin/Perfume Complexes

In addition to the uncomplexed cyclodextrins, the products herein can also contain from about 0.5% to about 60%, preferably from about 1% to about 50%, cyclodextrin/perfume inclusion complexes as disclosed in the patents incorporated herein by reference. Perfumes are highly desirable, can usually benefit from protection, and can be complexed with cyclodextrin. Fabric softening products typically contain perfume to provide an olfactory aesthetic benefit and/or to serve as a signal that the product is effective.

The perfume in such products is often lost before it is needed. Perfumes can be subject to damage and/or loss by the action of, e.g., oxygen, light, heat, etc. For example, due to the high energy input and large air flow in the drying process used in the typical automatic laundry dryers, a large part of the perfume provided by dryer-added softener products has been lost out the dryer vent. Even for less volatile components, as described hereinafter, only a small fraction remains on the fabrics after the drying cycle. The loss of the highly volatile fraction of the perfume, as described hereinafter, is much higher. Usually the loss of the highly volatile fraction is practically total. Due to this effect, many perfumes used in, e.g., dryer-added fabric softener compositions, have been composed mainly of less volatile, high boiling (having high boiling points), perfume components to maximize survival of the odor character during storage and use and thus provide better "substrate substantivity." The main function of a small fraction of the highly volatile, low boiling (having low boiling points), perfume components in these perfumes is to improve the fragrance odor of the product itself, rather than impacting on the treated fabric. However, some of the volatile, low boiling perfume ingredients can provide a fresh and clean impression to the fabric, and it is highly desirable that these ingredients be deposited and present on the fabric.

The perfume ingredients and compositions of this invention are the conventional ones known in the art. Selection of any perfume component, or amount of perfume, is based solely on aesthetic considerations. Suitable perfume compounds and compositions can be found in the art including U.S. Pat. Nos.: 4,145,184, Brain and Cummins, issued Mar. 20, 1979; 4,209,417, Whyte, issued Jun. 24, 1980; 4,515,705, Moeddel, issued May 7, 1985; and 4,152,272, Young, issued May 1, 1979, all of said patents being incorporated herein by reference. Many of the art recognized perfume compositions are relatively substantive, as described hereinafter, to maximize their odor effect on substrates. However, it is a special advantage of perfume delivery via the perfume/cyclodextrin complexes that nonsubstantive perfumes are also effective.

A substantive perfume is one that contains a sufficient percentage of substantive perfume materials so that when the perfume is used at normal levels in products, it deposits a desired odor on the treated fabric. In general, the degree of substantivity of a perfume is roughly proportional to the percentage of substantive perfume material used. Relatively substantive perfumes contain at least about 1%, preferably at least about 10%, substantive perfume materials.

Substantive perfume materials are those odorous compounds that deposit on substrates via the treatment process and are detectable by people with normal olfactory acuity. Such materials typically have vapor pressures lower than that of the average perfume material. Also, they typically have molecular weights of about 200 or above, and are detectable at levels below those of the average perfume material.

Perfumes can also be classified according to their volatility, as mentioned hereinbefore. The highly volatile, low boiling, perfume ingredients typically have boiling points of about 250° C. or lower. Many of the more moderately volatile perfume ingredients are also quickly lost. For example, substantially all of such perfumes are lost in the drying cycle of a typical laundry process. The moderately volatile perfume ingredients are those having boiling points of from about 250° C. to about 300° C. The less volatile, high boiling, perfume ingredients referred to hereinbefore are those having boiling points of about 300° C. or higher. A significant portion of even these high boiling perfume ingredients, considered to be highly substantive, can be lost, during a laundry drying cycle, and it is desirable to have means to retain more of these ingredients on the fabrics. Many of the perfume ingredients as discussed hereinafter, along with their odor characters, and their physical and chemical properties, such as boiling point and molecular weight, are given in "Perfume and Flavor Chemicals (Aroma Chemicals)," Steffen Arctander, published by the author, 1969, incorporated herein by reference.

Examples of the highly volatile, low boiling, perfume ingredients are: anethole, benzaldehyde, benzyl acetate, benzyl alcohol, benzyl formate, iso-bornyl acetate, camphene, cis-citral (neral), citronellal, citronellol, citronellyl acetate, paracymene, decanal, dihydrolinalool, dihydromyrcenol, dimethyl phenyl carbinol, eucalyptol, geranial, geraniol, geranyl acetate, geranyl nitrile, cis-3-hexenyl acetate, hydroxycitronellal, d-limonene, linalool, linalool oxide, linalyl acetate, linalyl propionate, methyl anthranilate, alpha-methyl ionone, methyl nonyl acetaldehyde, methyl phenyl carbinyl acetate, laevo-menthyl acetate, menthone, iso-menthone, myrcene, myrcenyl acetate, myrcenol, nerol, neryl acetate, nonyl acetate, phenyl ethyl alcohol, alpha-pinene, beta-pinene, gamma-terpinene, alpha-terpineol, beta-terpineol, terpinyl acetate, and vertenex (para-tertiary-butyl cyclohexyl acetate). Some natural oils also contain large percentages of highly volatile perfume ingredients. For example, lavandin contains as major components: linalool; linalyl acetate; geraniol; and citronellol. Lemon oil and orange terpenes both contain about 95% of d-limonene.

Examples of moderately volatile perfume ingredients are: amyl cinnamic aldehyde, iso-amyl salicylate, beta-caryophyllene, cedrene, cinnamic alcohol, coumarin, dimethyl benzyl carbinyl acetate, ethyl vanillin, eugenol, iso-eugenol, flor acetate, heliotropine, 3-cis-hexenyl salicylate, hexyl salicylate, lilial (para-tertiarybutyl-alpha-methyl hydrocinnamic aldehyde), gamma-methyl ionone, nerolidol, patchouli alcohol, phenyl hexanol, beta-selinene, trichloromethyl phenyl carbinyl acetate, triethyl citrate, vanillin, and veratraldehyde. Cedarwood terpenes are composed mainly of alpha-cedrene, beta-cedrene, and other $C_{15}H_{24}$ sesquiterpenes.

Examples of the less volatile, high boiling, perfume ingredients are: benzophenone, benzyl salicylate, ethylene brassylate, galaxolide (1,3,4,6,7,8-hexahydro-4,6,6,7,8,8-hexamethyl-cyclo-penta-gama-2-benzopyran), hexyl cinnamic aldehyde, lyral (4-(4-hydroxy-4-methyl pentyl)-3-cyclohexene-10-carboxaldehyde), methyl cedrylone, methyl dihydro jasmonate, methyl-beta-naphthyl ketone, musk indanone, musk ketone, musk tibetene, and phenylethyl phenyl acetate.

Cyclodextrin inclusion complexes (perfume/cyclodextrin, or perfume/CD, complexes), as described hereinafter, of the high boiling, the moderately volatile, and the low boiling perfume ingredients are stable (a) throughout the mixing of the complexes with the remainder of the compositions, e.g., the molten fabric softener mixes, especially when the fabric softener mixes contain some clay, and the coating of the resulting fabric softening compositions onto flexible substrates to form fabric conditioning sheets, (b) during the application of the composition to the substrate, e.g., during the drying of the wet fabrics in tumble dryers, and (c) during use, e.g., during the wearing of the dry fabrics. The content of the perfume in the cyclodextrin, e.g., β-cyclodextrin, inclusion complex is typically from about 5% to about 15%, more normally from about 7% to about 12%.

Perfume Complex Formation

The perfume/cyclodextrin inclusion complexes of this invention are formed in any of the ways known in the art. Typically, the complexes are formed either by bringing the perfume and the cyclodextrin together in a suitable solvent, e.g., water, or, preferably, by kneading/slurrying the ingredients together in the presence of a suitable, preferably minimal, amount of solvent, preferably water. The kneading/slurrying method is particularly desirable because it results in smaller particles so that there is less, or no, need to reduce the particle size and less solvent is needed and therefore less separation of the solvent is required. Other equivalent mechanical processes, e.g., milling, extrusion, etc., which require only small amounts of water and/or which result in very small particle sizes are desirable. Disclosures of complex formation can be found in Atwood, J. L., J. E. D. Davies & D. D. MacNichol, (Ed.): Inclusion Compounds, Vol. III, Academic Press (1984), especially Chapter 11; Atwood, J. L. and J. E. D. Davies (Ed.): Proceedings of the Second International Symposium of Cyclodextrins Tokyo, Japan, (Jul., 1984); and J. Szejtli, Cyclo-dextrin Technology, Kluwer Academic Publishers (1988). All of said publications are incorporated herein by reference.

In general, perfume/cyclodextrin complexes have a molar ratio of perfume compound to cyclodextrin of 1:1. However, the molar ratio can be either higher or lower, depending on the size of the perfume compound and the identity of the cyclodextrin compound. The molar ratio can be determined easily by forming a saturated solution of the cyclodextrin and adding the perfume to form the complex. In general the complex will precipitate readily. If not, the complex can usually be precipitated by the addition of electrolyte, change of pH, cooling, etc. The complex can then be analyzed to determine the ratio of perfume to cyclodextrin.

As stated hereinbefore, the actual complexes are determined by the size of the cavity in the cyclodextrin and the size of the perfume molecule. Although the normal complex is one molecule of perfume in one molecule of cyclodextrin, complexes can be formed between one molecule of perfume and two molecules of cyclodextrin when the perfume molecule is large and contains two portions that can fit in the cyclodextrin. Highly desirable complexes can be formed using mixtures of cyclodextrins since perfumes are normally mixtures of materials that vary widely in size. It is usually desirable that at least a majority of the material be alpha-, beta-, and/or gamma-cyclodextrin, more preferably beta-cyclodextrin.

Continuous complexation operations usually involve the use of supersaturated solutions, and/or mechanical processing, e.g., kneading/slurrying, and/or temperature manipulation, e.g., heating and then either cooling, freeze-drying, etc. The complexes may be dried, or not, depending on the next step in the process for making the desired composition. In general, the fewest possible process steps are preferred to avoid loss of perfume.

(iv) Dispensing Means

In a preferred substrate article embodiment, the fabric treatment compositions are provided as an article of manufacture in combination with a dispensing means such as a flexible substrate which effectively releases the composition in an automatic laundry (clothes) dryer. Such dispensing means can be designed for single usage or for multiple uses. The dispensing means can also be a "carrier material" that releases the fabric softener composition and then is dispersed and/or exhausted from the dryer.

The dispensing means will normally carry an effective amount of fabric treatment composition. Such effective amount typically provides sufficient fabric conditioning agent and/or anionic polymeric soil release agent for at least one treatment of a minimum load in an automatic laundry dryer. Amounts of fabric treatment composition for multiple uses, e.g., up to about 30, can be used. Typical amounts for a single article can vary from about 0.25 g to about 100 g, preferably from about 0.5 g to about 20 g, most preferably from about 1 g to about 10 g.

One such article comprises a sponge material releasably enclosing enough fabric treatment composition to effectively impart fabric soil release and softness benefits during several cycles of clothes. This multi-use article can be made by filling a hollow sponge with about 20 grams of the fabric treatment composition.

Other devices and articles suitable for dispensing the fabric treatment composition into automatic dryers include those described in U.S. Pat. Nos.: 4,103,047, Zaki et al., issued Jul. 25, 1978; 3,736,668, Dillarstone, issued Jun. 5, 1973; 3,701,202, Compa et al., issued Oct. 31, 1972; 3,634,947, Furgal, issued Jan. 18, 1972; 3,633,538, Hoeflin, issued Jan. 11, 1972; and 3,435,537, Rumsey, issued Apr. 1, 1969. All of these patents are incorporated herein by reference.

Highly preferred paper, woven or nonwoven "absorbent" substrates useful herein are fully disclosed in U.S. Pat. No. 3,686,025, Morton, issued Aug. 22, 1972, incorporated herein by reference. It is known that most substances are able to absorb a liquid substance to some degree; however, the term "absorbent" as used herein, is intended to mean a substance with an absorbent capacity (i.e., a parameter representing a substrate's ability to take up and retain a liquid) from 4 to 12, preferably 5 to 7, times its weight of water.

(v) Usage

The substrate embodiment of this invention can be used for imparting the above-described fabric treatment composition to fabric to provide odor control and/or perfume effects and/or softening and/or antistatic effects to fabric in an automatic laundry dryer comprises: commingling pieces of damp fabric by tumbling said fabric under heat in an automatic clothes dryer with an effective amount of the fabric treatment composition, at least the continuous phase of said composition having a melting point greater than about 35° C. and said composition being mobilized, e.g., flowable, at dryer operating temperature, said composition comprising from about 5% to about 70%, preferably from about 10% to about 60%,, more preferably from about 15% to about 50%, of uncomplexed cyclodextrin and, optionally, from about 0.5% to about 60%, preferably from about 1% to about 50%, more preferably from about 5% to about 40%, of perfume/cyclodextrin complex and from about 30% to about 95%, preferably from about 40% to about 90%, of fabric softening agent selected from the above-defined cationic and nonionic fabric softeners and mixtures thereof.

B. Detergent-Compatible Compositions

Another type of dryer activated fabric conditioning composition useful herein is detergent-compatible and includes compositions containing softening particles such as those known in the art, including specifically: U.S. Pat. No. 3,936,537, Baskerville Jr., issued Feb. 3, 1976, and U.S. Pat. No. 4,095,946, Jones, issued Jun. 20, 1978, both of which teach the use of intimate mixtures of organic dispersion inhibitors (e.g., stearyl alcohol and fatty sorbitan esters) with solid fabric softener to improve the survival of the softener in the presence of detergent in the washer so that the softener can act on the fabrics when it is mobilized in the dryer, and U.S. Pat. No. 4,234,627, Schilling, issued Nov. 18, 1980, which teaches microencapsulation of fabric softener (The microcapsules survive the wash and adhere to the fabric surface. They are then ruptured by subsequent tumbling of the fabric in the dryer, thereby releasing softener to the fabrics.)

The particles in such detergent-compatible fabric conditioning compositions comprise at least about 10% of fabric softening agent, preferably cationic fabric softening agent. For detergent compatibility, the particles often have a coating as described herein, a sufficiently large particle size (e.g., a minimum dimension greater than about 5,000 microns), or some combination of coating and particle size depending upon the level of protection desired.

The free cyclodextrin and any optional perfume/cyclodextrin complexes, as described hereinafter, are incorporated into fabric conditioning compositions, especially when the compositions are to be added to laundry detergents. It is believed that when the perfume/cyclodextrin complexes are encapsulated in fabric softener, they are attached to the fabric in the laundry dryer.

C. Optional Ingredients

Well known optional components included in fabric conditioning compositions are narrated in U.S. Pat. No. 4,103,047, Zaki et al., issued Jul. 25, 1978, for "Fabric Treatment Compositions," incorporated herein by reference.

Another preferred additional ingredient in the compositions herein is free perfume, other than the perfume which is present as the optional perfume/cyclodextrin inclusion complex, which is also very useful for imparting the odor benefits. Such uncomplexed perfume is preferably present at a level of from about 0.10% to about 10% by weight of the total.

For example, perfume delivery both via free perfume and cyclodextrin/perfume complexes, in solid, dryer-activated, fabric conditioning compositions in laundry fabric dryers is desirable in two ways. Product malodors can be covered by the addition of free perfume to the softener composition to obtain a more preferred product odor, and complexed perfume can be transferred onto fabric with the softener actives in the laundry fabric dryer to provide better in-wear fabric odor. (Preferably, such uncomplexed perfume comprises at least about 1%, more preferably at least about 10% by weight of said uncomplexed perfume, of substantive perfume materials.)

Products of this invention preferably only contain enough free perfume to deliver both an acceptably low product perfume odor and an acceptable initial fabric perfume odor. Perfume incorporated into the product in the form of perfume/CD complex as part of a substrate article or in the form of solid fabric softener particles containing perfume/CD complex (in the case of detergent compatible products), will be released when the fabric is used in situations where renewed perfume odor is really and appropriately needed, e.g., when some moisture is present, such as when using wash cloths and towels in a bathroom, or when there is perspiration odor on clothes during and after a high level of physical activity.

Laundry products can also contain only the optional perfume/CD complex, without any noticeable amount of free perfume. In this case, the products function initially almost as unscented products.

If a product contains both free and complexed perfume, the escaped perfume from the complex contributes to the overall perfume odor intensity, giving rise to a longer lasting perfume odor impression.

Thus, by adjusting the levels of free perfume and perfume/CD complex it is possible to provide a wide range of unique perfume profiles in terms of timing (release) and/or perfume identity (character). Solid, dryer-activated fabric conditioning compositions are a uniquely desirable way to apply the cyclodextrins, since they are applied at the very end of a fabric treatment regimen when the fabric is clean and when there are almost no additional treatments that can remove the cyclodextrin.

All percentages, ratios, and parts herein, in the Specification, Examples, and Claims, are by weight and approximations unless otherwise stated.

The following are nonlimiting examples of the instant articles and methods.

Uncomplexed Normal Cyclodextrin

Uncomplexed β-cyclodextrin is obtained from American Maize-Products Company. Particle size distribution analysis is determined using a Malvern Particle and Droplet Sizer, Model 2600C, sold by Malvern Instruments, Inc., Southborough, Mass. It is found that about 95% of this material has a particle size larger than 12 microns, with about 58% of the particles having a size in the 49 to 118 micron range.

Uncomplexed Cyclodextrin with Small Particle Size

The β-cyclodextrin sample obtained from American-Maize Products Company is ground in a Trost Air Impact Pulverizer jet mill (Research Model Gem-T), sold by Garlock, Inc., Newtown, Pa. After one pass through the jet mill, the particle size of the ground cyclodextrin is determined by Malvern Particle and Droplet Sizer, Model 2600C. It is found that practically the whole sample has a particle size of about 6 microns or smaller, with about 95% of the sample having a particle size of about 5 microns or smaller.

Two different perfumes used in the following Examples are as follows:

| Relatively Nonsubstantive Perfume (A) | | Substantive Perfume (B) | |
|---|---|---|---|
| Component | Wt. % | Component | Wt. % |
| Alpha Pinene | 5.0 | Benzyl Acetate | 5.0 |
| Cedarwood Terpenes | 20.0 | Benzyl Salicylate | 10.0 |
| Dihydro Myrcenol | 10.0 | Coumarin | 5.0 |
| Eugenol | 5.0 | Ethyl Maltol | 5.0 |
| Lavandin | 15.0 | Ethylene Brassylate | 10.0 |
| Lemon Oil CP | 10.0 | Galaxolide ® (50%) | 15.0 |
| Orange Terpenes | 15.0 | Hexyl Cinnamic Aldehyde | 20.0 |
| Phenyl Ethyl Alcohol | 20.0 | Gamma Methyl Ionone | 10.0 |
| Total | 100.0 | Lilial ® | 15.0 |
| | | Patchouli | 5.0 |
| | | Total | 100.0 |

Complex 1-Perfume A/β-CD

A mobile slurry is prepared by mixing about 1 kg of β-CD and about 500 ml of water in a stainless steel mixing bowl of a KitchenAid mixer using a plastic coated heavy-duty mixing blade. Mixing is continued while about 176 g of Perfume A is slowly added. The liquid-like slurry immediately starts to thicken and becomes a creamy paste. Stirring is continued for about 30 minutes. About 500 ml of water is added to the paste and blended well. Stirring is then resumed for an additional approximately 30 minutes. During this time the complex again thickens, although not to the same degree as before the additional water is added. The resulting creamy complex is freeze-dried to produce about 1100 g of powdery solid. Particle size distribution, including agglomerates, determined by the Malvern Particle and Droplet Sizer, Model 2600C, shows that about 92% of the complex powder has a size of about 11.1 microns, or less, and about 68% of the complex powder has a particle size of about 5.3 microns, or less. Examination of the complex particles by scanning electron microscopy shows that practically all of the ultimate (primary) particles of the complex have particle sizes less than about 5 microns.

Complex 2

Perfume B/fi-CD complex is prepared by the process of Complex 1.

| Components | Example 1 | Comparative Example 2 |
|---|---|---|
| Ditallowalkyldimethylammonium methyl sulfate (DTDMAMS) | 31.5 | 31.5 |
| Sorbitan Monostearate | 31.5 | 31.5 |
| Uncomplexed β-cyclodextrin, small-particle-size | 35.0 | — |
| Uncomplexed normal β-cyclodextrin | — | 35.0 |
| Calcium bentonite clay | 2.0 | 2.0 |
| Totals | 100.0 | 100.0 |

EXAMPLE 1

Preparation of the Coating Mix

An approximately 200 gram batch of the coating mix is prepared as follows. An amount of about 63 g of ditallowalkyldimethylammonium sulfate (DTDMAMS) (Sherex Chemical Co.) and about 63 g of sorbitan monostearate (Mazer Chemicals, Inc.) are melted together at about 80° C. The calcium bentonite clay (about 4 g of Bentolite L, available from Southern Clay Co.) is slowly added to the mixture with high shear mixing. During the mixing, the mixture is kept molten in a boiling water bath. The uncomplexed, ground, small-particle-size cyclodextrin (about 70 g) is then slowly added to the mixture with high shear mixing, and the formula is mixed until the mixture is smooth and homogenous.

Preparation of Fabric Conditioning Sheets

The coating mixture is applied to preweighed nonwoven substrate sheets of about 9 inch×11 inch (approximately 23 cm×28 cm) dimensions. The substrate sheets are comprised of about 70% 3-denier, 1-9/16 inch (approximately 4 cm) long rayon fibers with about 30% polyvinyl acetate binder. The substrate weight is about 16 g per square yard (about 1.22 g/sheet). A small amount of formula is placed on a heated metal plate with a spatula and then is spread evenly with a wire metal rod. A nonwoven sheet is placed on the metal plate to absorb the coating mixture. The sheet is then removed from the heated metal plate and allowed to cool to room temperature so that the coating mix can solidify. The sheet is weighed to determine the amount of coating mixture on the sheet. The target coating is 4.0 g per sheet. If the weight is in excess of the target weight, the sheet is placed back on the heated metal plate to remelt the coating mixture and remove some of the excess. If the weight is under the target weight, the sheet is also placed on the heated metal plate and more coating mixture is added.

COMPARATIVE EXAMPLE 2

The coating mix preparation and the making of the fabric conditioning sheets are similar to those in Example 1, except that the uncomplexed normal cyclodextrin is used instead of the uncomplexed, ground, small-particle-size cyclodextrin.

Fabric Treatment

Three laundry loads containing the same composition of garments, each load including a 50/50 poly/cotton pillow case, are washed in three automatic washers with unscented TIDE® detergent. The wet laundry loads are transferred to, and dried in, three electric tumble dryers with, respectively, a fabric conditioning sheet of Example 1; a fabric conditioning sheet of Comparative Example 2; and without any fabric conditioning sheet. After drying, the three pillow cases from the three laundry loads are hung in a recreation room full of tobacco odor. After about 30 minutes, the pillow case treated with the fabric conditioning sheet of Example 1 has noticeably less tobacco odor than the pillow case treated with the fabric conditioning sheet of Comparative Example 2 or the pillow case which is not treated with any fabric conditioning sheet. Flat woven fabric materials such as pillow cases or shirt fabrics show the most noticeable benefit. Textured fabrics, such as cotton terries, show less benefit. It is believed that this occurs because textured fabrics have more untreated areas which do not provide the benefit.

| Components | Example 3 | Comparative Example 4 |
|---|---|---|
| DTDMAMS | 17.2 | 17.2 |
| Sorbitan monostearate | 17.2 | 17.2 |
| Octadecyldimethylamine | 10.0 | 10.0 |
| $C_{16-18}$ fatty acids | 17.6 | 17.6 |
| Uncomplexed β-cyclodextrin, small-particle-size | 35.0 | — |
| Uncomplexed, normal β-cyclodextrin | — | 35.0 |
| Calcium bentonite clay | 3.0 | 3.0 |
| Totals | 100.0 | 100.0 |

EXAMPLE 3

A first blend of about 10 parts octadecyldimethylamine (Ethyl Corporation) and about 17.6 parts $C_{16-18}$ fatty acid (Emery Industries, Inc.) are melted together at 80° C., and a second blend of about 17.2 parts sorbitan monostearate (Mazer Chemicals, Inc.) and about 17.2 parts ditallowalkyldimethylammonium methylsulfate, DTDMAMS, (Sherex Chemical Co.) are melted together to form the softener component of the composition, during which time the mixture is kept molten in a boiling water bath. The calcium bentonite clay (about 3 parts Bentolite L, available from Southern Clay Co.) is then slowly added to the mixture while high shear mixing. An amount of about 35 parts of uncomplexed, ground, small-particle-size β-cyclodextrin is then added in small portions and the formula is mixed until the mixture is smooth and completely homogenous.

The coating mixture is applied to preweighed nonwoven substrate sheets as in Example 1. The target coating is 4 g per sheet. Each sheet contains about 2.48 g of softener, about 0.12 g of clay, and about 1.4 g of β-cyclodextrin.

COMPARATIVE EXAMPLE 4

The softener mixture of Comparative Example 4 is prepared similarly to that of Example 3. However, the coating mixture of Comparative Example 4 contains uncomplexed, normal P-cyclodextrin instead of the uncomplexed, ground, small-particle-size β-cyclodextrin.

Fabric Treatment

Three laundry loads containing the same composition of garments, each load including a 50/50 poly/cotton pillow case, are washed in three automatic washers with unscented TIDE® detergent. The wet laundry loads are transferred to, and dried in, three electric tumble dryers with, respectively, a fabric conditioning sheet of Example 3; a fabric conditioning sheet of Comparative Example 4; and without any fabric conditioning sheet. After drying, the three pillow cases from the three laundry loads are hung in a recreation room full of tobacco odor. After about 30 minutes, the pillow case treated with the fabric conditioning sheet of Example 3 has noticeably less tobacco odor than the pillow case treated with the fabric conditioning sheet of Comparative Example 4 or the pillow case which is not treated with any fabric conditioning sheet.

| Components | Example 5 | Example 6 |
|---|---|---|
| DTDMAMS | 17.2 | 11.3 |
| Sorbitan monostearate | 17.2 | 17.3 |
| Octadecy1dimethylamine | 10.0 | 10.0 |
| $C_{12-14}$ fatty acid | 7.6 | |
| $C_{16-18}$ fatty acid | 10.0 | 17.0 |
| Uncomplexed β-cyclodextrin, small-particle-size | 20.0 | 16.7 |
| Complex 1 | — | 16.7 |
| Complex 2 | 15.0 | — |
| Free Perfume B | — | 1.7 |
| Calcium bentonite clay | 3.0 | 3.3 |
| Totals | 100.0 | 100.0 |

EXAMPLE 5

A first blend of about 10 parts octadecyldimethylamine (Ethyl Corporation), about 7.6 parts $C_{12-14}$ fatty acid and about 10 parts of $C_{16-18}$ fatty acid (Emery Industries, Inc.) are melted together at about 80° C., and a second blend of about 17.2 parts sorbitan monostearate (Mazer Chemicals, Inc.) and about 17.2 parts ditallowalkyldimethylammonium methylsulfate, DTDMAMS, (Sherex Chemical Co.) are melted together to form the softener component of the composition, during which time the mixture is kept molten in a boiling water bath. The calcium bentonite clay (about 3 parts Bentolite L, available from Southern Clay Co.) is then slowly added to the mixture while high shear mixing. An amount of about 35 parts mixed cyclodextrin/cyclodextrin complex (about 20 parts of uncomplexed, ground, small-particle-size β-cyclodextrin and about 15 parts of Complex 2) are then added in small portions and the formula is mixed until the mixture is smooth and completely homogenous.

The coating mixture is applied to preweighed nonwoven substrate sheets as in Example 1. The target coating is 4 g per sheet. Each sheet contains about 2.48 g of softener, about 0.12 g of clay, and about 1.4 g of β-cyclodextrin and β-cyclodextrin/perfume inclusion complex mixture.

EXAMPLE 6

A dryer-added fabric conditioning article comprising a rayon nonwoven fabric substrate [having a weight of about 1.22 g per 99 sq. in. (approximately 639 $cm^2$)] and a fabric conditioning composition is prepared in the following manner.

A premixture is prepared by admixing about 10 parts octadecyldimethylamine with about 17 parts C16-$1_8$ fatty acid at about 75° C. Then about 17.3 parts sorbitan monostearate and about 17.3 parts ditallowalkyldimethylammonium methylsulfate are added with high shear mixing at about 75° C. After the addition is completed and a sufficient period of mixing time has elapsed, about 3.3 parts of Bentolite L particulate clay is added slowly while maintaining the high shear mixing action. Then about 16.7 parts of uncomplexed, ground, small-particle-size β-CD and about 16.7 parts of Complex 1 are added with mixing. Finally about 1.7 parts of free Perfume B is added to complete the preparation of the fabric conditioning composition.

The flexible substrate, comprised of about 70% 3-denier, 1-9/16 inch long (approximately 4 cm) rayon fibers and about 30% polyvinyl acetate binder, is impregnated by coating one side of a continuous length of the substrate and contacting it with a rotating cylindrical member which serves to press the liquified mixture into the interstices of the substrate. The amount of fabric conditioning mixture applied is controlled by the flow rate of the mixture and/or the line speed of the substrate. The substrate is passed over several chilled tension rolls which help solidify the conditioning mixture. The substrate sheet is about 9 inches wide (approximately 23 cm) and is perforated in lines at about 11 inch intervals (approximately 28 cm) to provide detachable sheets. Each sheet is cut with a set of knives to provide three evenly spaced parallel slits averaging about 4 inches in length (approximately 10 cm). In this Example 6, the application rate is adjusted to apply about 3 g of coating mixture per sheet. Each sheet contains about 1.85 g of softener, about 0.19 of clay, about 0.5 g of β-CD, and about 0.5 g of Complex 3, and about 0.05 g of free Perfume B.

Shirts treated in tumble dryer with a sheet of either Example 5 or Example 6 and worn by a constant cigarette smoker have noticeably lower tobacco odor than shirts that are not treated.

Examples of Detergent-Compatible Particles

Softener Core Particles

| Components | Example 7 | Example 8 |
|---|---|---|
| Ditallowalkyldimethylammonium methylsulfate (DTDMAMS) | 38.51 | 38.51 |
| Cetyl alcohol | 19.17 | 19.17 |
| Sorbitan monostearate | 19.17 | 19.17 |
| Uncomplexed, ground, small-particle-size β-CD | 20.15 | 10.15 |
| Complex 1 | — | 10.00 |
| Calcium bentonite clay | 3.00 | 3.00 |
| Totals | 100.00 | 100.00 |

EXAMPLE 7

The DTDMAMS, cetyl alcohol and sorbitan monostearate are blended together in a PVM 40 Ross mixer (Charles Ross & Sons Company, Hauppauge, N.Y.) at about 71° C. The molten "triblend" is then mixed for about one hour. At the end of one hour, the temperature is raised to about 79°–85° C. under vacuum (about 330–430 mm Hg). When the temperature has stabilized in this range, the Ross anchor and disperser are turned on and the cyclodextrin and the clay are added, the mixture is blended for about 5 minutes and then sheared with the Ross colloid mixer for about 10 minutes. The softener composition is then poured into trays and cooled overnight at about 4° C. Particles are formed by cooling and then milling in a Fitzmill, Model DA506 (The Fitzpatrick Company, Elmhurst, Ill.) at 4740 rpm's through a 4 mesh screen. The particles are then sized through 11 on 26 (U.S. Standard screens, (0.6–1.7 mm) particle size).

The particles are then coated with a 10% solution of Ethocel in methanol. The coating is applied in an 18 inch Wurster Coater (Coating Place, Inc., P.O. Box 248, Verona, Wis.). The ethyl cellulose used is Ethocel Std. 10 (Dow Chemical Co., Midland, Mich.), which has an Ubbelohde viscosity of about 9.0–11.0, measured at 25° C. as a 5% solution in 80% toluene/20% ethanol.

The following conditions are used to apply the cellulose-based coating:

| | |
|---|---|
| Fluidizing Air | 15.8 Cu.M/min. at 40.5° C. |
| Atomizing Air Volume | 0.31 Cu.M/min. |
| Atomizing Air Rate | 5624 g/sq.cm. |
| Inlet Air Temperature | 38° C.–43° C. |
| Outlet Air Temperature | 30° C.–32° C. |
| Pump Rate | 0.2 Kg/min. |
| Nozzle Size | CPI-18-A74* |
| Partition Gap | 216 mm × 267 mm |
| Partition Size | 19 mm |
| Run Time | 55 min. |

*Available from Coating Place, Inc.

The amount of coating applied to the particles is about 3% by weight of the total coated particle weight. When the coating is completed, the softener particles are resized through 11 on 26 mesh U.S. Standard screens and are then ready for use "as is" or for blending into detergent granules.

EXAMPLE 8

Softener particles of Example 8 are prepared similarly to the particles of Example 7, with the exception that the mixture of uncomplexed β-CD and Complex 1 is used in place of all uncomplexed β-CD.

EXAMPLE 9

A detergent/softener composition is prepared by mixing about 5.2 parts of the coated softener particles of Example 7 with about 94.8 parts of the following granular detergent composition:

| Ingredient | Parts |
|---|---|
| Na $C_{13}$ linear alkyl benzene sulfonate | 9.5 |
| Na $C_{14}$–$C_{15}$ fatty alcohol sulfate | 9.5 |
| Ethoxylated $C_{12}$–$C_{13}$ fatty alcohol | 1.9 |
| $Na_2SO_4$ | 11.1 |
| Sodium silicate (1.6r) | 6.5 |
| Polyethylene glycol (M.W. 8,000) | 0.1 |
| Polyacrylic acid (M.W. 1,200) | 0.9 |
| Sodium tripolyphosphate | 31.0 |
| Sodium pyrophosphate | 7.5 |
| $Na_2CO_3$ | 10.2 |
| Optical brightener | 0.2 |
| Protease enzyme (Alcalase) | 0.7 |
| Moisture | 9.3 |
| Free Perfume B | 1.0 |
| Total | 100.0 |

EXAMPLE 10

Alternate granular detergent/softener compositions are prepared by mixing about 5.2 parts of the coated softener of Example 8 with about 94.8 parts of the following granular detergent composition:

| Ingredient | Parts |
|---|---|
| Na $C_{13}$ linear alkyl benzene sulfonate | 11.5 |
| Na $C_{14}$–$C_{15}$ fatty alcohol sulfate | 11.5 |
| Ethoxylated $C_{12}$–$C_{13}$ fatty alcohol | 1.9 |
| $Na_2SO_4$ | 14.0 |
| Sodium silicate (1.6r) | 2.3 |
| Polyethylene glycol (M.W. 8,000) | 1.8 |
| Polyacrylic acid (M.W. 1,200) | 3.5 |
| Hydrated Zeolite A (~2 microns) | 28.9 |
| $Na_2CO_3$ | 11.0 |
| Optical brightener | 0.2 |
| Protease enzyme (Alcalase) | 0.6 |
| Perfume B | 1.0 |
| Moisture and Miscellaneous | 5.8 |
| Total | 100.0 |

What is claimed is:

1. An article of manufacture comprising:

I. a fabric conditioning composition comprising:
  i. from about 30% to about 95% of fabric softening agent; and
  ii. an effective amount of uncomplexed cyclodextrin having a particle size of less than about 12 microns;
  iii. optionally, an effective amount of cyclodextrin/perfume inclusion complex;

II. a dispensing means which provides for release of an effective amount of said composition to fabrics in an automatic laundry dryer at automatic laundry dryer operating temperatures.

2. The article of manufacture of claim 1 wherein the amount of uncomplexed cyclodextrin is from about 5% to about 70%; said effective amount of cyclodextrin/perfume inclusion complex is from about 0.5% to about 60%; and said automatic laundry dryer operating temperatures are from about 35° C. to about 115° C.

3. The article of manufacture of claim 2 wherein the particle size of said uncomplexed cyclodextrin and any cyclodextrin/perfume inclusion complex is between about 0.001 and about 10 microns.

4. The article of manufacture of claim 3 wherein said particle size is between about 0.05 and about 5 microns.

5. The article of manufacture of claim 2 wherein said cyclodextrin is selected from the group consisting of: unsubstituted cyclodextrins containing from about six to about twelve glucose units; derivatives of said unsubstituted cyclodextrins; and mixtures thereof, and wherein said cyclodextrin is capable of forming inclusion complexes with odor compounds.

6. The article of manufacture of claim 5 wherein at least a major portion of said cyclodextrin is selected from the group consisting of: alpha-cyclodextrin; beta-cyclodextrin; gamma-cyclodextrin; and mixtures thereof.

7. The article of manufacture of claim 6 wherein at least a major portion of said cyclodextrin is beta-cyclodextrin.

8. The article of manufacture of claim 7 wherein at least a major portion of said particle size is from about 0.001 microns to about 10 microns.

9. Flat woven fabrics having an effective amount, sufficient to provide odor control, of uncomplexed cyclodextrin having a particle size of less than about 12 microns attached thereto.

10. The fabrics of claim 29 wherein said cyclodextrin is beta-cyclodextrin.

* * * * *